United States Patent [19]

Maina

[11] Patent Number: 4,901,771

[45] Date of Patent: Feb. 20, 1990

[54] CASING FOR WEFT STORAGE AND FEEDING DEVICE

[75] Inventor: Bruno Maina, Valdengo, Italy

[73] Assignee: ROJ Electrotex S.p.A., Biella, Italy

[21] Appl. No.: 261,249

[22] Filed: Oct. 11, 1988

[30] Foreign Application Priority Data

Oct. 12, 1987 [IT] Italy ..... 22526 B/87

[51] Int. Cl.[4] ..... D03D 47/36

[52] U.S. Cl. ..... 139/452

[58] Field of Search ..... 139/429, 435, 452

[56] References Cited

U.S. PATENT DOCUMENTS

| | | | |
|---|---|---|---|
| 4,429,723 | 2/1984 | Maroino | 139/452 |
| 4,614,311 | 9/1986 | Kakinaka | 139/452 |
| 4,632,155 | 12/1986 | Maina | 139/452 |

*Primary Examiner*—Henry S. Jaudon

*Attorney, Agent, or Firm*—Young & Thompson

[57] ABSTRACT

A casing for weft storage and feeding devices for use in weaving looms comprises a central body housing the motor; and a peripheral arm guiding and supporting the brake unit, the sensor detecting the yarn reserve, and the yarn-guide eyelet. The casing is formed from at least one extruded section length.

5 Claims, 2 Drawing Sheets

CASING FOR WEFT STORAGE AND FEEDING DEVICE

BACKGROUND OF THE INVENTION

The weft feeding devices for weaving looms or for textile machines in general (also briefly called weft feeders), now used on all modern shuttleless looms, are usually of the type with a drum for weft yarn storage, incorporating a coaxial electric motor. The weft yarn, unwound from a reel or bobbin, is wound in turns by a rotor on the drum, so as to form a reserve thereon, from which the loom subsequently draws the weft yarn with a tension being as uniform and as regular as possible.

The overall structure most commonly adopted by constructors for these devices comprises a casing formed of a central body housing the electric motor and of a peripheral arm rigidly connected to the central body and supporting a weft yarn brake unit, a sensor detecting the amount of yarn wound on the drum, and a yarnguide eyelet.

The central body of the device is required to have a proper rigidity and high thermal dissipation properties, while the peripheral arm, as well as being suitably stiff, should also act as a sliding and support guide for the brake unit, for the sensor detecting the yarn reserve and for the yarnguide, these members having to be easily movable longitudinally along the arm, so as to control the strength of the braking action on the yarn being fed from the device and, respectively, the yarn reserve being stored on the drum.

The main longitudinal axis of the device corresponds to the motor and drum axes, while the longitudinal axis of the sliding guide should be parallel to the main axis, so as to always allow proper alignment of the brake unit and of the detector in respect of the remaining part of the device.

To satisfy these requirements, in the casings of known weft feeders, the central body is conventionally obtained by casting of aluminum or "zamak" (or other alloy) and, for large production quantities, diecasting is obviously adopted, involving considerable investments for the casting equipment.

As concerns the peripheral support and guiding arm, it should be rigidly fixed to the central body and can be made from different materials and using different methods, for instance by casting of aluminium, zamak or other alloys (adopting diecasting for large quantities of pieces), with the sliding guides incorporated into the arm and eventually obtained by subsequent machining, or made of stamped iron plate or extruded bar and performing simultaneously the dual function of support and guide, or made of section iron or of a similar material with the sliding guides obtained by machining, or finally also obtained by simultaneously adopting two or more of these systems, like associating a secion iron as support with an aluminium extrusion as sliding guide.

In any case, all these systems require a proper fixing between the various parts forming the casing, as well as supplementary machinings which are often neither simple nor economical.

Furthermore, to give a pleasant aspect to the weft feeder, one usually provides for surface finishings, like varnishing and/or applying closing and finishing elements, generally of plastic material, these steps involving costs and structural complications which should well be taken into consideration.

SUMMARY OF THE INVENTION

The present invention now proposes to supply a casing for weft storage and feeding devices which is much simpler and more economical to produce than the conventional ones and which requires no finishing steps to improve its appearance, thereby providing further advantages from the economical point of view.

The casing for weft storage and feeding devices according to the invention is substantially characterized in that it is formed from at least one extruded section length.

Said extruded section length will have to be suitably machined, removing parts thereof by simple cutting, while other simple and inexpensive machinings may be performed thereon for adjustment purposes.

The casing will preferably be formed from two extruded section lengths, firmly connected one to the other.

Extruded sections of aluminium or aluminium alloys are the most suited to construct the casing of the present invention.

BRIEF DESCRIPTION OF THE DRAWINGS

The invention is now described in further detail, with reference to a preferred embodiment thereof, wherein the casing for weft storage and feeding device is formed from two extruded section lengths. This embodiment is illustrated in the accompanying drawings, in which.

DESCRIPTION OF THE PREFERRED EMBODIMENT

With reference to the drawings, the present invention proposes to use, for the construction of a weft feeder casing, a pair of section lengths obtained by extrusion, preferably of aluminium or aluminium alloys, associated one to the other by known methods.

Figure 1:
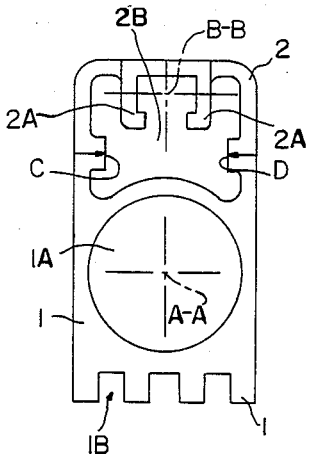
FIG. 1 is a cross section view of the two extruded section lengths, associated to form the casing according to the invention.
Figure 2:
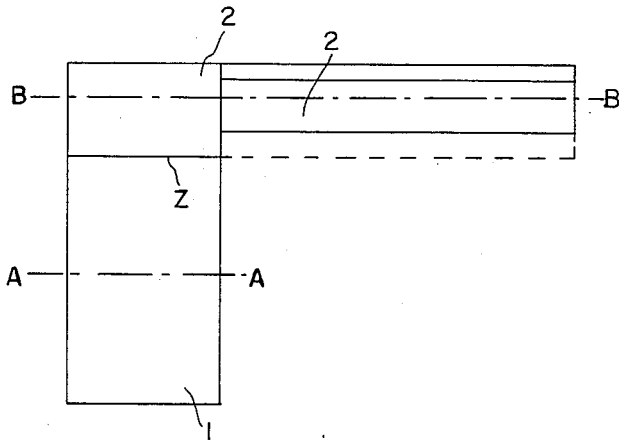
FIGS. 2 and 3 are a side view and a top view of the two lengths of FIG. 1, associated to form the casing according to the invention.
Figure 3:
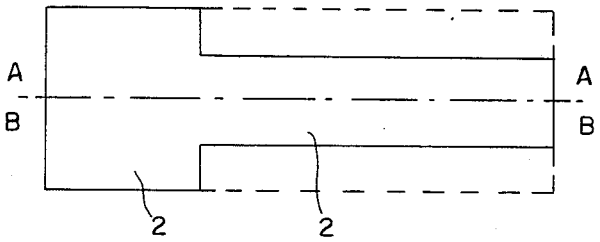

As shown in FIGS. 1 to 3, the casing is obtained from an extruded length 1, forming the central body with axis A—A, which houses the weft feeder motor in its cylindrical cavity 1A, and from an extruded length 2, with axis B—B, forming the peripheral support and guiding arm. The length 1 already comprises fins 1B, adapted to efficiently dissipate the heat from the motor and to facilitate mounting and position adjustment of the weft feeder on the loom or other textile machine onto which it is applied. In the length 2, the inner projections 2A form the sliding guide for the sensor detecting the yarn reserve, while the cavity 2B is adapted to house—along the length 1 and of the motor contained therein—the cards of the electronic circuits controlling the weft feeder.

The extruded lengths 1 and 2 are obtained by simply cutting them into the size exactly required for the purposes having to be fulfilled, from considerably long extruded sections easily obtainable on the market. The length 1, forming the central body, is therefore considerably shorter than the length 2, which forms the arm.

It should be noted that this arrangement is possible thanks to the fact that the cross section of the casing has been divided, as shown in FIG. 1, along the zones C and D.

Figure 5:
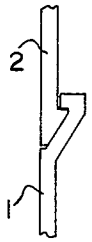
FIGS. 5 to 10 are suitably enlarged section views, corresponding to the zones C, D, of FIG. 1, showing methods of associating the section lengths of FIG. 1 in order to obtain the casing according to the invention.
Figure 6:
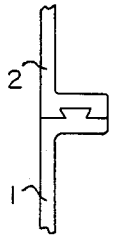
Figure 7:
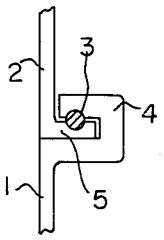
Figure 8:
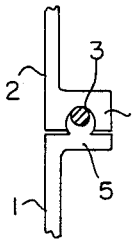
Figure 9:
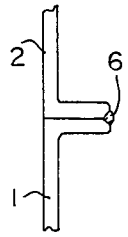
Figure 10:
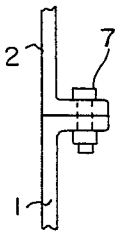

On the other hand, along such zones, it is necessary to provide for the tight connection between the two lengths, in order to give to the casing of the invention the required monolithic structure. This may be obtained in any known manner, for instance by simply fixing together the extruded lengths, suitably shaped for the purpose—as shown in FIG. 5, where the engagement is favoured by the elasticity of the section length 2; or in FIG. 6, where a conventional dovetail engagement is obtained; or in FIGS. 7 and 8, where a free sliding engagement is obtained between the two lengths 1 and 2, fixing them together by pressure insertion of a frusto-conical pin 3 into flange elements 4 and 5 thereof, provided with suitable seats—or by connecting the lengths 1 and 2 with a welding seam 6—as shown in FIG. 9—or even by simply fixing together the two lengths by means of screws, bolts or transverse rivets 7—as shown in FIG. 10. In any case, the choice of the type of connection depends on the geometry of the profile and on the experience of the firm producing the extruded sections. The important thing is to actually obtain a monolithic structure of the casing.

The solution according to the invention allows to construct the casing of a weft feeder making use of the extrusion technique, by means of which it is possible to obtain bars of considerable length, with the desired profile, and having fairly close tolerances so as to often avoid machining.

In fact, as seen, the profile of the section of the casing is determined by the profile of the die used for the extrusion of the section lengths, the cost of which is fairly contained compared to that of pressure casting dies, and which allows to extrude aluminium and its alloys.

On the other hand, these lengths are obtained—as also seen—by an elementary cutting of bar sections which can easily be found on the market, and they require practically no finishing operations. In fact, the structure formed therewith can be left unchanged in the finished device, as it has a pleasant appearance. Alternatively, since the structure is usually made of aluminium, a surface finishing can be provided by simple anodizing (to be executed also on the full bar and being in any event of limited cost).

Figure 4:
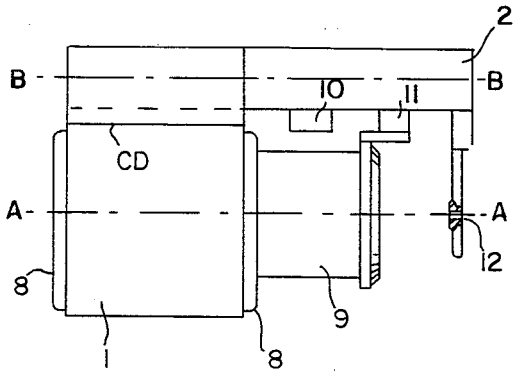
FIG. 4 is a comprehensive view of a weft feeder constructed with the casing of FIGS. 1 to 3.

FIG. 4 shows diagrammatically a complete weft feeder constructed with the casing according to the invention. In it can be seen: the main axis A—A and the axis B—B of the sliding guide; the casing according to the invention, comprising the central body formed from the length 1 and the peripheral arm formed from the length 2, tightly connected one to the other in the zone CD to form a monolithic structure; flanges 8 for closing the central body and supporting the motor shaft; a drum 9 around which the yarn reserve is wound; the sensor 10 for detecting the yarn reserve; the brake unit 11; and the outlet eyelet 12.

It can be noted that, through a fully original and highly advantageous construction of the casing or carrying structure of the device, it has been possible to obtain a conventional weft feeder configuration.

Since the operations involving cutting the bar sections, to obtain the lengths 1 and 2, and then removing the excess parts of such lengths—see dashed lines of FIGS. 2 and 3 for the length 2—are very simple and thus economical, and since, moreover, the initial investment for the extrusion die is modest and it is possible to avoid any extra body parts, while the surface finishing treatment is not required, or is in any event simple and economical, the solution proposed by the invention is particularly important from the economic point of view. This is all the more true when considering, furthermore, that the removed parts of the section lengths can be easily recycled, the energy consumption for aluminium and its alloys being advantageously low.

Moreover, the monolithic body generally requires very little machining, on account of the dimensional precision of the extruded piece and, if the section design has been carefully planned, the machining can even be avoided or reduced to merely boring the housing for the motor.

It is understood that the invention covers any other embodiments thereof apt to satisfy the same requirements. In particular, it covers a casing obtained from a single length of extruded bar, the cross section of which substantially corresponds to the assembly of FIG. 1 (imagining the separation lines C and D between parts 1 and 2 not to be there, said parts forming in this case a single body), and the cutting of which takes place in two stages, so as to obtain first of all a length of the size of the casing arm, and subsequently remove therefrom the surplus portion to the side of said arm to obtain the shorter central body, up to forming a casing substantially like that shown in FIGS. 1 to 3 (wherein, in addition to lines C and D, also the separation line Z between lengths 1 and 2 in FIG. 2 should be eliminated), but—unlike that—obtained in one piece.

A construction of this type obviously provides the advantages of a totally monolithic structure of the casing and of a faster and simpler production thereof in finished form, but it involves further waste of material (even if its recovery is particularly easy and convenient); moreover, there can be practical difficulties of construction since use has to be made of extruders having a power and dimensions which are not easy to find on the market.

What is claimed:

1. Casing for a weft storage and feeding device, for use in weaving looms, comprising a central body adapted to house a motor of said feeding device; and a peripheral arm for guiding and supporting a brake unit and a sensor detecting a yarn reserve and a yarnguide eyelet of said feeding device; wherein said casing comprises at least one extruded section length.

2. Casing according to claim 1, wherein at least a portion of said at least one extruded section length has a machined surface to improve the appearance thereof.

3. Casing according to claim 1, wherein said casing comprises two extruded section lengths rigidly secured to one another.

4. Casing according to claim 3, wherein said central body and said peripheral arm are separately extruded section lengths rigidly secured to one another.

5. Casing according to claim 1, wherein said at least one extruded section length comprises aluminum or aluminum alloy.

* * * * *